United States Patent [19]

Hein

[11] Patent Number: 4,552,010

[45] Date of Patent: Nov. 12, 1985

[54] PULLING HEAD FOR BLIND FASTENERS

[75] Inventor: James R. Hein, Lakewood, Calif.

[73] Assignee: Olympic Fastening Systems, Downey, Calif.

[21] Appl. No.: 628,824

[22] Filed: Jul. 9, 1984

[51] Int. Cl.[4] ..... B21D 9/05

[52] U.S. Cl. ..... 72/391; 72/481

[58] Field of Search ..... 72/391, 481, 480, 477, 72/478, 482, 473, 453.17, 453.19; 29/243.52, 33 J; 81/57.5

[56] References Cited

U.S. PATENT DOCUMENTS

| | | | |
|---|---|---|---|
| 1,142,797 | 6/1915 | Burrell | 72/477 |
| 3,777,540 | 12/1973 | Siebol et al. | 72/391 |
| 4,059,980 | 11/1977 | Nance | 72/391 |
| 4,344,311 | 8/1982 | Riveter | 72/391 |
| 4,407,619 | 10/1983 | Siebol | 411/43 |
| 4,425,782 | 1/1984 | Todisco | 72/391 |

*Primary Examiner*—Francis S. Husar
*Assistant Examiner*—Linda McLaughlin
*Attorney, Agent, or Firm*—Fulwider, Patton, Rieber, Lee & Utecht

[57] ABSTRACT

An improved pulling head is provided for setting blinds fasteners, such as by pulling the setting pin of a blind rivet or the like, wherein the pulling head is rapidly and easily adjustable for use with blind fasteners of different sizes or types. The improved pulling head comprises an elongated support housing carrying a sliding draw bolt assembly for grasping and pulling a setting pin inserted into a nose end of the support housing through a selected one of a plurality of head inserts of selected different sizes or types. The head inserts are carried by a generally cone-shaped turret cap mounted at the support housing nose end for rotation about an axis offset from the direction of sliding draw bolt assembly movement thereby permitting the selected head insert to be rotated to an operative position in front of the draw bolt assembly and the remaining nonselected head inserts to be stationed in inoperative positions spaced from contact with the structure being fastened. The pulling head is adjusted by simple rotation of the turret cap to rotate an alternative selected head insert to the operative position, with a spring-loaded detent mechanism acting between the turret cap and the support housing to releasably retain the selected head insert in the operative position.

32 Claims, 10 Drawing Figures

PULLING HEAD FOR BLIND FASTENERS

BACKGROUND OF THE INVENTION

This invention relates generally to tools for setting blind fasteners, such as blind rivets and the like. More particularly, this invention relates to an improved so-called pulling head for pulling and setting blind fasteners wherein the improved pulling head is quickly and easily adjustable to permit use with blind fasteners of different sizes and/or types.

Blind fasteners in general are relatively well known for connecting two or more lapped workpieces, particularly wherein the workpieces are accessible from one side only. Typically, such blind fasteners include a tubular sleeve having a diametric size to fit through aligned holes in the workpieces and an enlarged head at one end, in combination with a setting pin having an elongated pulling section sized to fit through the sleeve and a blind end expansion head sized to fit through the workpiece holes but not through the headed sleeve. In use, the blind fastener is assembled with the setting pin received through the sleeve with its pulling section projecting from the headed sleeve end and its expansion head abutting the opposite end of the sleeve. The thus-assembled fastener is then inserted through the aligned workpiece holes to position the sleeve head flush with the accessible side of the workpieces and the setting pin expansion head beyond the blind side of the workpieces. The blind fastener is set by pulling the setting pin toward the accessible side of the workpieces by means of an appropriate pulling tool, resulting initially in upsetting and enlargment of the blind sleeve end followed by progressive clamping of the workpieces tightly between the sleeve head and the now-enlarged blind sleeve end. Further application of pulling force to the setting pin severs or breaks the pin substantially flush with the sleeve head to provide a low profile fastener clamping the workpieces tightly together. Exemplary blind fasteners of this general type are shown and described in U.S. Pat. No. 4,407,619.

A variety of setting tools have been proposed for use in pulling and setting blind fasteners of the above-referenced type. These setting tools, commonly referred to as "pulling heads," have generally included a so-called draw bolt assembly mounted for sliding movement within a tool housing, wherein the draw bolt assembly and tool housing are adapted for removable mounting onto an appropriate power-driven or manually operated pulling mechanism. The draw bolt assembly includes means for grasping and pulling a blind fastener setting pin guidably inserted into the tool housing through a housing nose cap. Examples of such pulling heads are those marketed by Olympic Fastening Systems of Downey, Calif., under the model designations RV811 and RV812.

However, in such previous pulling heads, the nose cap for the tool housing has generally been designed for use with a fastener setting pin of a single size. Alternatively, in some instances, the housing nose cap has included an exterior surface geometry for use with a blind fastener of a single type. Accordingly, it has been necessary to acquire several different pulling heads of different sizes and/or types to provide the desirable capability to install blind fasteners of different sizes or types. This requirement for multiple pulling heads, however, undesirably increases user costs and further requires time-consuming interchanging of pulling heads on a pulling mechanism whenever a blind fastener of a different size or type is desired. Moreover, unused pulling heads are subject to occasional misplacement to further increase user inconvenience and/or cost.

There exists, therefore, a significant need for an improved pulling head for setting blind fasteners wherein the pulling head is adjustable quickly and easily without removal of components therefrom to accommodate blind fasteners of different sizes and/or types. The present invention fulfills this need and provides further related advantages.

SUMMARY OF THE INVENTION

In accordance with the invention, an improved pulling head is provided for pulling and setting blind fasteners of a plurality of selected predetermined sizes or types. The improved pulling head is adapted for use with a standard power-driven or manually operated pulling mechanism and includes a sliding draw bolt assembly for grasping and pulling the setting pin of a blind fastener to clamp and fasten two or more lapped workpieces. The fastener setting pin is inserted into engagement with the draw bolt assembly through one of a plurality of head inserts of different sizes and/or types and carried by a turret cap mounted rotatably at the front or nose end of a support housing for the draw bolt assembly. The turret cap is rotatable to interchangeably station a selected one of the head inserts in an operative position in front of the draw bolt assembly for receiving the fastener setting pin.

In the preferred form of the invention, the turret cap has a generally conical configuration having the plurality of head inserts formed on the exterior surface thereof in a generally circular, equally spaced pattern. The turret cap further includes a generally conical recessed underside bearing surface for seating upon a generally complementary shaped part-conical support surface formed on a nose cap at the front or nose end of the support housing. This part-conical support surface on the nose cap is formed about a conic axis tilted or offset at an angle preferably of about 45 degrees to the axis of draw bolt assembly sliding movement. The turret cap is mounted onto the support housing in coaxial alignment with and for rotation about the conic axis of the nose cap to permit rotation of the selected head insert on the turret cap to the operative position aligned coaxially in front of the draw bolt assembly and with the remaining nonselected head inserts in inoperative positions spaced rearwardly from the selected head insert. A spring-loaded ball detent mechanism cooperating between the turret cap and a portion of the support housing, such as the nose cap, releasably retains the turret cap against rotation with the selected head insert in the operative position.

In use, the turret cap is rotated on the support housing to quickly, easily, and interchangeably station the selected head insert in the operative position aligned coaxially in front of the draw bolt assembly. In this operative position, the improved pulling head is operated in a conventional manner to pull and set blind fasteners of a particular size and/or type. Adjustment of the pulling head for use with blind fasteners of a different size and/or type is accomplished quickly and easily by simple rotation of the turret cap.

Other features and advantages of the present invention will become more apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
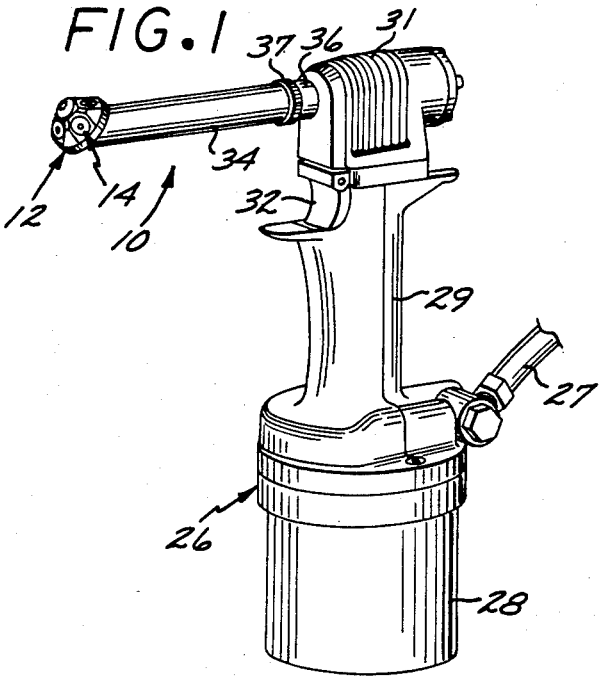
FIG. 1 is a perspective view of a blind fastener pulling head embodying the novel features of the invention and shown installed upon an exemplary power-driven pulling mechanism.
Figure 3:
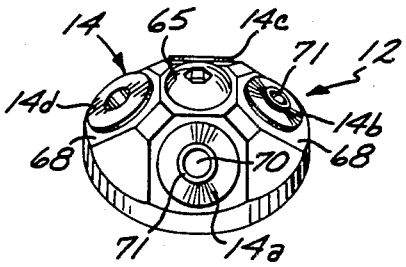
FIG. 3 is a front or nose end elevation view of the pulling head.
Figure 4:
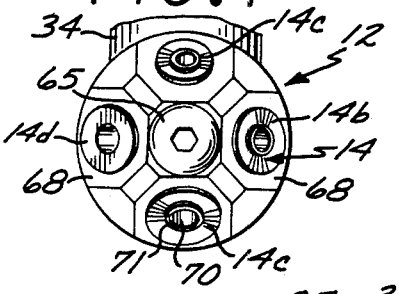
FIG. 4 is an oblique generally front end view of the pulling head, taken generally on the line 4—4 of FIG. 2.

As shown in the exemplary drawings, an improved pulling head referred to generally by the reference numeral 10 is provided for pulling and setting blind fasteners, such as by pulling the setting pin of a blind rivet or the like. The improved pulling head 10 includes a rotatable turret cap 12 at a front or nose end thereof, wherein this turret cap 12 carries a plurality of head inserts 14 designed for use with blind fasteners of respective different sizes and/or types. The pulling head 10 is adjustable quickly and easily by simple rotation of the turret cap 12 to station a selected one of the head inserts 14 in an operative position.

Figure 6:
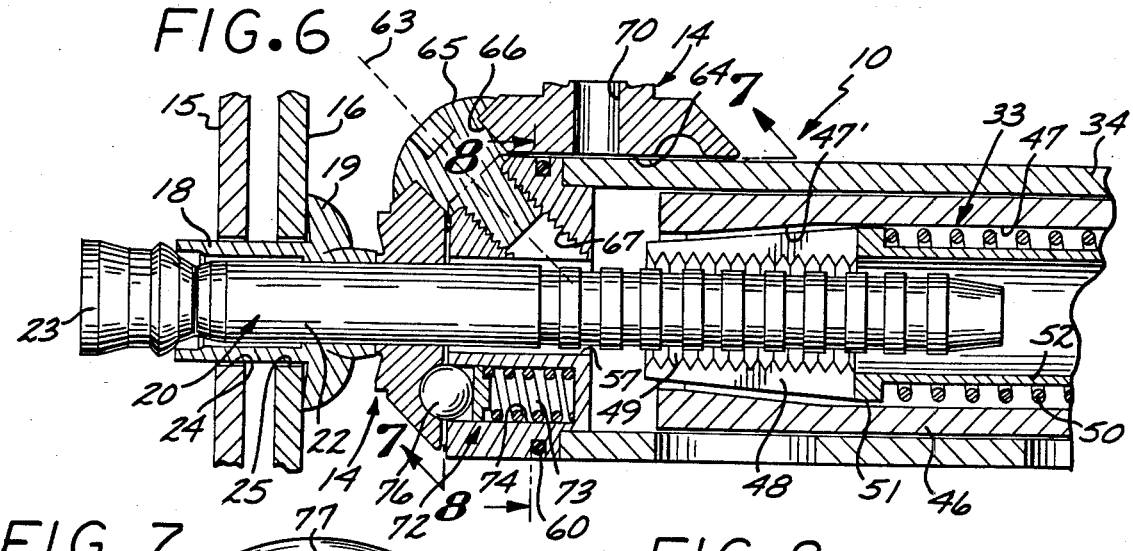
FIG. 6 is an enlarged fragmented vertical sectional view of a portion of the improved pulling head and illustrating an initial step in the pulling and setting of a blind fastener.
Figure 7:
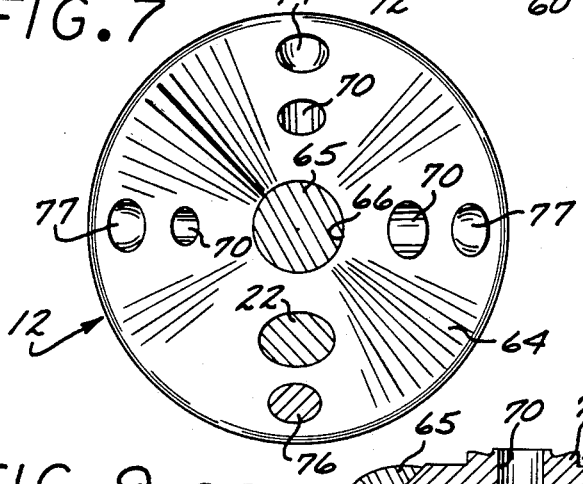
FIG. 7 is a developed sectional view taken generally on the line 7—7 of FIG. 6.

The improved pulling head 10 of the present invention provides a convenient, economical, and rapidly adjustable device for use in pulling and setting blind fasteners particularly of the general type illustrated in FIG. 6 for use in fastening two or more lapped workpieces 15 and 16. In general, such blind fasteners include a tubular sleeve 18 having a radially enlarged head 19 at one end, in combination with a so-called setting pin 20 having an elongated pulling section 22 sized to fit through the sleeve 18 and a somewhat enlarged expansion head 23 of a diametric size greater than the inner diameter of the tubular sleeve 18. These blind fastener components are preassembled with the setting pin pulling section 22 projecting from the headed end of the sleeve 18 and with the pin expansion head 23 abutting the unheaded or blind end of the sleeve 18. The expansion head 23 and sleeve 18 are then inserted through aligned openings 24 and 25 in the workpieces, after which the setting pin pulling section 22 is grasped, pulled, and severed by operation of the pulling head 10 to clamp and fasten the workpieces 15 and 16 tightly together. Further descriptive details of such blind fasteners may be had by reference to commonly assigned U.S. Pat. No. 4,407,619, which is incorporated by reference herein.

The improved pulling head including the rotatable turret cap 12 advantageously is designed for pulling and setting different sizes or manufactured styles of blind fasteners generally of the above-referenced type. More particularly, each head insert 14 on the turret cap 12 is designed for use with a respective different fastener size or style, whereby simple rotation of a selected head insert 14 to an operative position is required for rapidly and easily adjusting the pulling head 10 for use with different blind fasteners. Previous requirements for multiple blind fastener pulling heads and time-consuming interchanging thereof are thus avoided.

Figure 2:
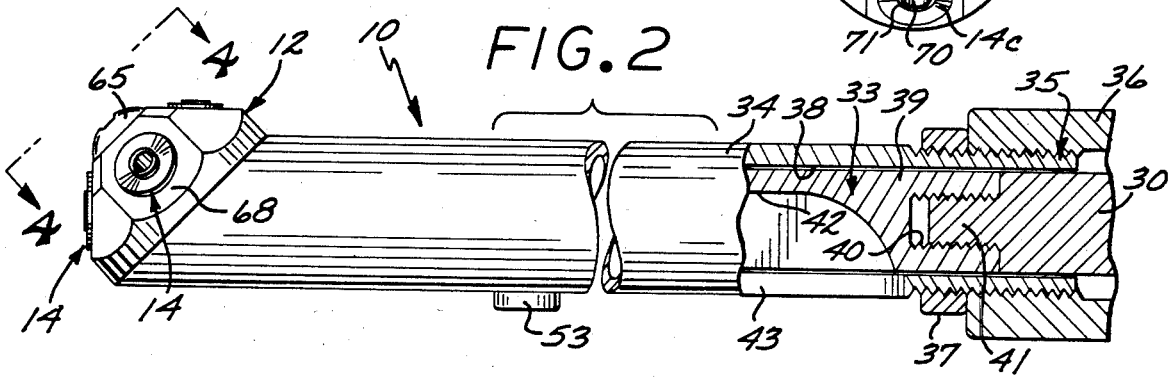
FIG. 2 is an enlarged fragmented side elevation view of the pulling head, with portions broken away to illustrate mounting thereof onto the exemplary pulling mechanism.

As shown in FIGS. 1 and 2, the improved pulling head 10 is depicted in one preferred form for use with a power-driven pulling mechanism 26 of a conventional type. The exemplary pulling mechanism 26 is driven by air under pressure supplied through a pneumatic hose 27 into a tool base 28 typically encasing a pneumatic cylinder unit (not shown) coupled in turn through an hydraulic cylinder unit (also not shown) within a tool hand grip for retracting a so-called head piston 30 (FIG. 2) within a tool head 31 whenever a trigger 32 is depressed. The head piston 30 draws rearwardly upon a draw bolt assembly 33 forming a portion of the pulling head 10 to pull and set a blind fastener, as will be described in more detail. Exemplary of such pulling mechanisms, sometimes referred to as "pulling guns," are those marketed by Olympic Fastener Systems of Downey, Calif., under the model designations RV14GB and RV30. Alternatively, other pulling mechanisms or guns known to those skilled in the art may be used with the improved pulling head 10 including, but not limited to, both power-driven and manually operated devices.

As shown best in FIG. 2, the improved pulling head 10 includes an elongated and generally cylindrical support housing 34 having an externally threaded rear end 35 for threaded reception into a collar 36 forming a portion of the tool head 31 and surrounding the head piston 30. A lock nut 37 is conveniently provided about the threaded housing rear end 35 and may be rotated snugly into engagement with the axial end of the collar 36 to secure the housing 34 against inadvertent or undesired rotation during use. The draw bolt assembly 33 is slidably carried within an open bore 38 of the support housing 34 and includes a draw bolt 39 with an internally threaded socket 40 at its rear end for threaded connection onto a connector shaft 41 projecting forwardly from the head piston 30.

Figure 5:
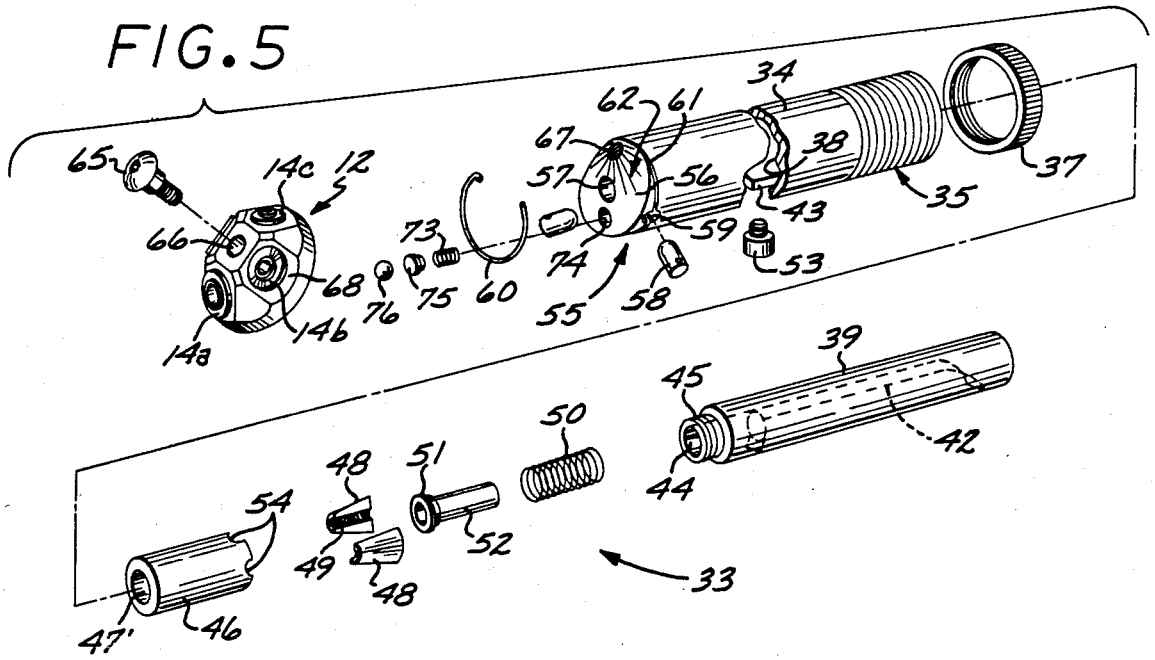
FIG. 5 is an exploded perspective view illustrating assembly of the improved pulling head.

The draw bolt assembly 33 is generally conventional in construction and operation. More particularly, as viewed in FIGS. 2, 5, and 6, the draw bolt assembly 33 includes the draw bolt 39 having a downwardly opening and longitudinally extending eject chamber 42 formed therein in substantial vertical alignment with an underlying slot 43 formed in the support housing 34. The eject chamber 42 communicates with a short bolt passage 44 which opens forwardly through an externally threaded connector sleeve 45 of reduced diameter at the front end of the draw bolt. This connector sleeve is threadably receivable into the rear end of a cylindrical collet 46 having an axially open bore 47 with a forward tapered region 47' (FIG. 6) of decreasing cross-sectional size in a forward direction. A pair of longitudinally split and externally tapered gripping jaws 48 having internal serrated gripping surfaces 49 are received within the collet 46 and urged forwardly toward a position nesting with the tapered bore region 47' by a biasing spring 50 reacting between the draw bolt connector sleeve and an enlarged forward flange 51 of a cylindrical follower sleeve 52.

The entire draw bolt assembly 33 slides as a unit forwardly and rearwardly within the support housing 34, in accordance with actuation of the head piston 30 of the pulling mechanism 36. This forward and rearward sliding movement occurs without rotation of the draw bolt assembly 33, wherein such rotation could otherwise uncouple the draw bolt 34 from the head piston 30 or uncouple the collet 46 from the forward end of the draw bolt 39. Rotation of the draw bolt assembly is prevented by a small guide screw 53 threaded radially into the draw bolt 39 near the forward end thereof to occupy one of a plurality of generally semicircular notches 54 in the rear end of the collet 46. The head of this guide screw 53 is disposed within the elongated slot 43 in the support housing 34 whereby said screw 53 prevents rotation of the draw bolt assembly 33 throughout its sliding movement within the support housing.

Figure 8:
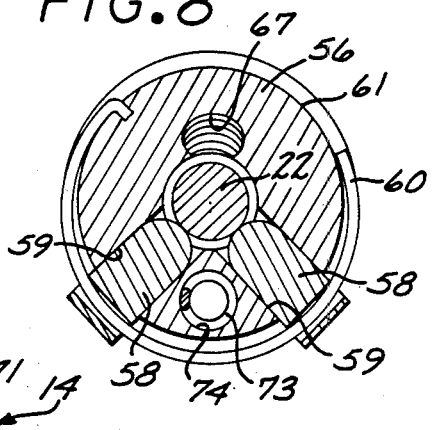
FIG. 8 is a vertical sectional view taken generally on the line 8—8 of FIG. 6.

The nose or front end 55 of the support housing 34 is substantially closed by a nose cap 56. As shown best in FIG. 6, this nose cap 56 includes a reduced diameter rear extension sized to fit snugly within the nose or front end of the cylindrical housing and is securely connected thereto as by brazing, welding, or the like. A central pin passage 57 is formed through the nose cap 56 generally in coaxial alignment with a central axis of the support housing 34 and thus also coaxially aligned with the draw bolt assembly 33. Importantly, this pin passage 57 is sized to permit substantially unrestricted insertion of the pulling section 22 of a blind fastener setting pin 20 of a wide range of diametric sizes and different manufactured styles. Conveniently, as viewed in FIG. 8, conventional ratchet pins 58 protrude through radially open bores 59 in the nose cap 56 and are biased by a ring spring 60 seated within an external groove 61 to project partially into the pin passage 57 to deter forward withdrawal of a setting pin once it has been inserted through the pin passage 57.

The exterior, generally forwardly facing surface of the nose cap 56 comprises, in the illustrative preferred embodiment, a bearing support surface 62 of generally part-conical geometric contour. As shown best in FIGS. 5 and 6, this part-conical bearing support surface 62 is centered on a conic axis 63 which is tilted or offset upwardly from a central axis of the support housing 34 and the draw bolt assembly 33. While the angular relationship between there axes may vary, a preferred tilt or offset angle of about 45 degrees is preferred in combination with a part-conical and turret cap contour which orients the selected head insert 14 generally perpendicularly to the support housing central axis, as will be described in more detail. This specific angular relationship further provides the turret cap with a minimum profile size for facilitating access into small areas of the type commonly present in many fastening operations, particularly in the aerospace industry.

The turret cap 12 including the plurality of head inserts 14 is supported upon the nose cap 56 for rotation about the tilted or offset conic axis 63. More particularly, the turret cap 12 has a generally conical shape including a generally conical recessed underside bearing surface 64 formed generally to conform with the bearing surface 62 on the nose cap 56. Accordingly, the turret cap 12 fits matingly onto the nose cap 56 with a portion overlapping the upper forward end of the cylindrical housing 34. A shoulder screw 65 is receivable through an apex opening 66 in the turret cap and is fastened into a threaded apex bore 67 in the nose cap 56 to rotatably secure the turret cap onto the nose cap generally coaxially with the offset conic axis 63.

Figure 9:
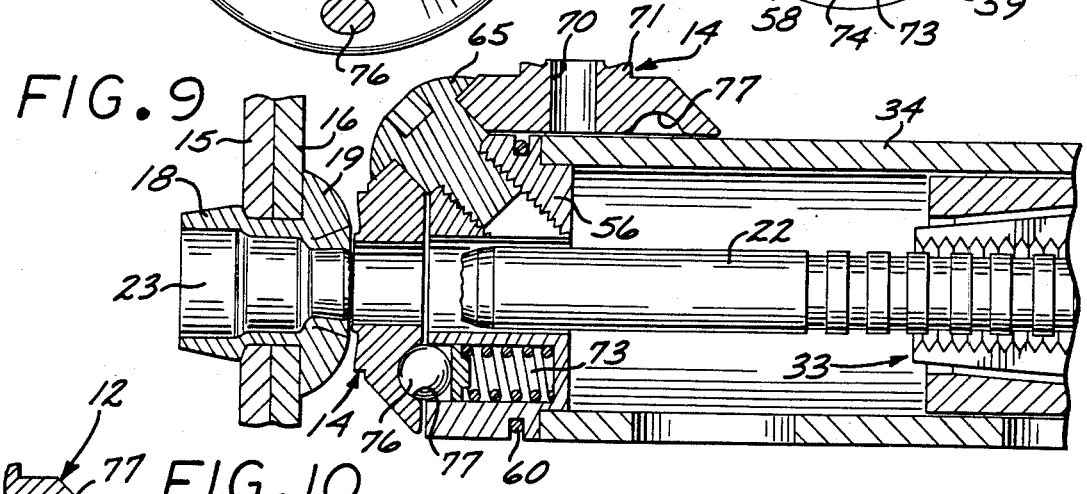
FIG. 9 is a fragmented vertical sectional view generally similar to FIG. 6 and illustrating the pulling head in a subsequent step in pulling and setting the blind fastener.

The exterior exposed surface of the turret cap 12 also has a generally conical overall configuration divided, in the illustrative embodiment, into a plurality of generally planar facets 68, several of which include a respective one of the head inserts 14 arranged about the turret cap in a generally circular, equally spaced pattern. These head inserts are uniquely contoured to accommodate blind fasteners of different sizes and/or types, with four of said head inserts 14 being shown by way of example in the illustrative embodiment of the invention. More specifically, by way of example only, three head inserts **14*a*, 14*b*, and 14*c* may be provided respectively with centrally formed setting pin passages 70 for close tolerance reception of the setting pin pulling section 22 of blind fasteners of three different sizes, such as ⅛-inch, 5/32-inch, and 3/16-inch, respectively. These three head inserts 14*a*, 14*b*, and 14*c* each include an outwardly projecting annular rim 71 bounding the pin passages 70 for imparting a predetermined surface geometry to the enlarged head 19 of a blind fastener sleeve 18, as viewed in FIGS. 6 and 9, in accordance with blind fasteners of a particular manufacturer's style. The illustrative fourth head insert 14*d* is shown to include a central pin passage 70 which may be any selected size and which is shown to exclude the upstanding rim 71** in accordance with a blind fastener of a different manufacturer's style.

In use, a selected one of the head inserts 14 is stationed at an operative position in front of the draw bolt assembly 33 by appropriate rotation of the turret cap 12 about the offset conic axis 63. In the operative position, the selected head insert 14 is oriented with its pin passage 70 generally in coaxial alignment with the nose cap pin passages 57 and further in coaxial alignment with the draw bolt assembly 33. Moreover, the selected head insert is oriented generally in a plane perpendicular to the axis of the draw bolt assembly, whereas the remaining nonselected head inserts are disposed at rearwardly spaced positions away from possible contact with the workpieces being fastened together.

A detent mechanism 72 reacts between the turret cap 12 and the nose cap 56 of the support housing 34 to releasably retain the turret cap in the selected rotational position. In the preferred form, this detent mechanism 72 comprises a relatively small compression spring 73 seated within a forwardly open recess 74 in the nose cap 56 to urge a small end plug 75 in a forward direction against a detent ball 76. This detent ball 76 is partially receivable into one of a plurality of shallow part-spherical detents 77 formed in the underside bearing surface 64 of the turret cap 12 to releasably halt turret cap rotation each time one of the inserts 14 is in the operative position. The turret cap 12 remains rotatable, however, by application of sufficient rotational force to displace the detent ball 76 from the aligned detent 77 deeper into the nose cap recess 74 as the turret cap rotates a different head insert 14 to the operative position.

Figure 10:
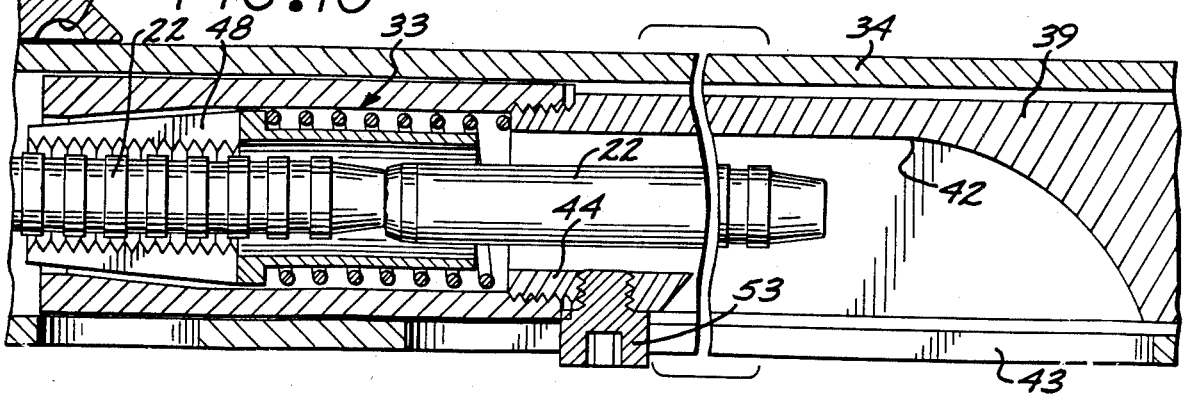
FIG. 10 is an enlarged fragmented vertical sectional view generally similar to portions of FIG. 6 and illustrating further operation in the pulling and setting of a blind fastener.

When the selected head insert 14 is stationed at the operative position, the improved pulling head 10 of the present invention is operated in a generally conventional manner for pulling and setting of blind fasteners. More particularly, as viewed in FIG. 6, the pulling section 22 of a setting pin 20 is inserted through the head insert 14 and further into grasped relation with the gripping jaws of the draw bolt assembly 33. The draw bolt assembly 33 is then actuated to pull rearwardly upon the setting pin 20 resulting in an initial upsetting and expansion of the blind end of the tubular sleeve 18 by the pin expansion head 23. Continued application of pulling force to the setting pin 20 eventually clamps the workpieces 15 and 16 tightly together and then severs the setting pin 20 substantially flush with the sleeve head 19. The severed portion of the setting pin is normally ejected from the pulling head through the draw bolt eject chamber 42. However, a severed pin pulling section failing to eject is displaced into the eject chamber by insertion of a subsequent setting pin into the draw bolt assembly 33, as viewed in FIG. 10.

Whenever a different fastener style or size is desired, the turret cap 12 is rotatable quickly and easily to station a new selected head insert 14 in the operative position in front of the draw bolt assembly 33. This adjustment of the pulling head occurs quickly and easily without requiring the assistance of any tool and further without requiring removal of any components from the pulling head.

A variety of modifications and improvements to the improved pulling head described herein are believed to be apparent to those skilled in the art. Accordingly, no limitation on the invention is intended by way of the description herein, except as set forth in the appended claims.

What is claimed is:

1. A pulling head for pulling and setting blind fasteners of a plurality of different types, said pulling head comprising:

an elongated, generally hollow support housing having an opening at a front nose end thereof to permit individual insertion into said housing of the different types of blind fasteners;

a draw bolt assembly slidably carried within said housing and including means for grasping and pulling a blind fastener inserted into said housing through said nose end opening;

a turret cap including a plurality of head inserts shaped for receiving and setting the respective different types of blind fasteners; and means rotatably mounting said turret cap on said support housing for movement of an interchangeably selected one of said head inserts to an operative position generally overlying and aligned with said nose end opening and the remaining ones of said head inserts to nonoperative positions spaced rearwardly from said selected one of said head inserts.

2. The pulling head of claim 1 wherein said pulling head is adapted for use with a pulling mechanism having a draw piston slidably carried within a tool head, said support housing including means for removable attachment of a rear end thereof to the tool head, and said draw bolt assembly including means for removable attachment to said draw piston.

3. The pulling head of claim 1 further including means releasably retaining said turret cap against rotation when said turret cap is rotated to a position with one of said head inserts in the operative position.

4. The pulling head of claim 3 wherein said retaining means comprises a detent mechanism cooperating between said turret cap and said support housing.

5. The pulling head of claim 1 wherein said support housing comprises an elongated, generally cylindrical housing member having a nose cap at the nose end thereof, said nose end opening being formed in said nose cap.

6. The pulling head of claim 5 wherein said draw bolt assembly is slidable within said cylindrical housing member generally along a central axis thereof, said nose end opening in said nose cap being generally coaxially aligned with said central axis and having a size and shape sufficient to permit insertion therethrough of the different types of blind fasteners.

7. The pulling head of claim 5 wherein said nose cap has an exterior surface defining a bearing surface of generally part-conical configuration oriented about a conic axis offset with respect to said central axis of said housing member, said turret cap having a generally conical configuration for rotational support upon said part-conical bearing surface of said nose cap, said mounting means comprising means rotatably mounting said turret cap generally coaxially aligned with said conic axis.

8. The pulling head of claim 7 wherein said conic axis is oriented at about 45 degrees with respect to said central axis.

9. The pulling head of claim 7 wherein said turret cap has said head inserts formed on the exterior surface thereof in a generally circular pattern in respective planes to orient each of said head inserts generally perpendicularly to the central axis of said housing member when said head insert is in the operative position.

10. The pulling head of claim 9 wherein said turret cap has a generally conical recessed underside bearing surface for seated support upon said part-conical bearing surface of said nose cap.

11. The pulling head of claim 7 wherein said mounting means comprises a shoulder screw fastened generally through the apex of said turret cap into the apex of said part-conical bearing surface of said nose cap.

12. The pulling head of claim 7 wherein each of said head inserts is formed on said turret cap within a respective one of a plurality of generally planar facets defining the exterior surface of said turret cap.

13. The pulling head of claim 5 further including a detent mechanism for releasably retaining said turret cap against rotation when one of said head inserts is in the operative position, said detent mechanism including a detent ball receivable into a forwardly open recess formed in said nose cap, spring means for urging said detent ball outwardly from said recess, and a plurality of recessed detents formed in the underside of said turret cap at positions for movement of one of the detents into general alignment with said nose cap recess for partial reception of said detent ball when one of said head inserts is in the operative position.

14. The pulling head of claim 1 wherein said turret cap has a generally conical configuration with said head inserts carried thereby on the exterior surface thereof in a generally circular pattern arranged about the apex of said turret cap, said mounting means rotatably supporting said turret cap for rotation about a conic axis offset with respect to a central axis of said support housing.

15. The pulling head of claim 14 wherein each of said head inserts has a passage formed therein of a size and shape tailored to correspond with the respective associated type of blind fastener, said passage being rotated to a position generally coaxially aligned with said nose end opening when said head insert is in the operative position.

16. A pulling head for pulling and setting blind fasteners of a plurality of different types, said pulling head comprising:

an elongated support housing having a bore formed therein and an opening at a front nose end thereof to permit individual insertion into said bore of the different types of blind fasteners;

means slidably carried within said bore for grasping and pulling a blind fastener inserted thereinto through said nose end opening;

a plurality of head inserts shaped for receiving and setting the respective different types of blind fasteners; and means carrying said head inserts and mounted on said housing for moving said head inserts together with respect to said housing for displacing an interchangeably selected one of said head inserts to an operative position generally aligned with said nose end opening and for displacing the remaining ones of said head inserts in nonoperative positions generally out of alignment with said nose end opening.

17. The pulling head of claim 16 wherein said head insert carrying means includes means for displacing said remaining ones of said head inserts to said nonoperative positions spaced rearwardly from said selected one of said head inserts.

18. The pulling head of claim 16 further including means releasably retaining said head insert carrying means against movement when one of said head inserts is in the operative position.

19. The pulling head of claim 16 wherein said head insert carrying means comprises a turret cap of generally conical shape mounted on said support housing for rotation about a conic axis offset with respect to a central axis of said support housing.

20. The pulling head of claim 16 wherein each of said head inserts has a passage formed therein of a size and shape tailored to correspond with the respective associated type of blind fastener, said passage being rotated to a position generally coaxially aligned with said nose end opening when said head insert is in the operative position.

21. In a pulling head for pulling and setting blind fasteners, said pulling head including an elongated hollow support housing having an opening at a front nose end thereof to permit individual insertion of blind fasteners and a draw bolt assembly within the housing for grasping and pulling a blind fastener inserted through the nose end opening, apparatus for adapting said pulling head for use in pulling and setting blind fasteners of a plurality of different types, said apparatus comprising:

a plurality of head inserts shaped for receiving and setting the respective different types of blind fasteners; and means carrying said head inserts and mounted on said housing for moving said head inserts together with respect to said housing for displacing an interchangeably selected one of said head inserts to an operative position generally aligned with said nose end opening and for displacing the remaining ones of said head inserts in nonoperative positions generally out of alignment with said nose end opening.

22. The apparatus of claim 21 wherein said head insert carrying means includes means for displacing said remaining ones of said head inserts to said nonoperative positions spaced rearwardly from said selected one of said head inserts.

23. The apparatus of claim 21 further including means releasably retaining said head insert carrying means against movement when one of said head inserts is in the operative position.

24. The apparatus of claim 21 wherein said head insert carrying means comprises a turret cap of generally conical shape mounted on said support housing for rotation about a conic axis offset with respect to a central axis of said support housing.

25. The apparatus of claim 21 wherein each of said head inserts has a passage formed therein of a size and shape tailored to correspond with the respective associated type of blind fastener, said passage being rotated to a position generally coaxially aligned with said nose end opening when said head insert is in the operative position.

26. A pulling head for receiving and pulling the setting pin of blind fasteners of a plurality of different types, said pulling head comprising:

a support housing including an elongated housing member having a bore formed therein, and a nose cap mounted at a front nose end of said housing member and having an opening formed therein generally coaxial with a central axis of said housing member and having a size and shape for individual insertion into said housing member of the different types of blind fasteners;

a draw bolt assembly slidably carried within said housing member bore and including means for grasping and pulling a blind fastener inserted into said bore through said nose cap opening;

a turret cap of generally conical shape carrying a plurality of head inserts respectively corresponding in geometry with the different types of blind fasteners, said head inserts being arranged on the exterior surface of said turret cap in a generally equally spaced circular pattern centered about the apex of said turret cap; and means rotatably mounting said turret cap on said nose cap for rotation about a conic axis of said turret cap offset relative to the central axis of said housing member for interchangeably stationing a selected one of said head inserts in an operative position generally overlying and coaxially aligned with said nose cap opening and the remaining ones of said head inserts to nonoperative positions spaced rearwardly from said selected one of said head inserts.

27. The pulling head of claim 26 wherein said pulling head is adapted for use with a pulling mechanism having a draw piston slidably carried within a tool head, said support housing including means for removable attachment of a rear end thereof to the tool head, and said draw bolt assembly including means for removable attachment to said draw piston.

28. The pulling head of claim 26 wherein said nose cap has an exterior surface defining a bearing surface of generally part-conical configuration oriented about said conic axis offset with respect to said central axis of said housing member, said turret cap being rotationally supported upon said part-conical bearing surface of said nose cap, said means rotatably mounting said turret cap onto said nose cap with said turret cap generally coaxially aligned with said conic axis.

29. The pulling head of claim 28 wherein said turret cap has a generally conical recessed underside bearing surface for seated support upon said part-conical bearing surface of said nose cap.

30. The pulling head of claim 28 wherein said mounting means comprises a shoulder screw fastened generally through the apex of said turret cap into the apex of said part-conical bearing surface of said nose cap.

31. The pulling head of claim 28 further including a detent mechanism for releasably retaining said turret cap against rotation when one of said head inserts is in the operative position, said detent mechanism including a detent ball receivable into a forwardly open recess formed in said nose cap, spring means for urging said detent ball outwardly from said recess, and a plurality of recessed detents formed in the underside of said turret cap at positions for movement of one of the detents into general alignment with said nose cap recess for partial reception of said detent ball when one of said head inserts is in the operative position.

32. The pulling head of claim 26 wherein each of said head inserts has a passage formed therein of a size and shape tailored to correspond with the respective associated type of blind fastener, said passage being rotated to a position generally coaxially aligned with said nose end opening when said head insert is in the operative position.

* * * * *